United States Patent [19]

Fowler et al.

[11] 4,416,472

[45] Nov. 22, 1983

[54] HOLDDOWN AND PACKOFF APPARATUS

[75] Inventors: John H. Fowler; David L. Gruller, both of Houston, Tex.

[73] Assignee: Smith International, Inc., Newport Beach, Calif.

[21] Appl. No.: 219,323

[22] Filed: Dec. 22, 1980

[51] Int. Cl.[3] ..... F16L 35/00

[52] U.S. Cl. ..... 285/3; 285/39; 285/142; 285/315; 285/321; 285/351; 166/88; 166/217

[58] Field of Search ..... 285/18, 86, 87, 139, 285/140, 141, 142, 143, 315, 321, 351, 3, 39; 166/182, 88, 208, 217

[56] References Cited

U.S. PATENT DOCUMENTS

| | | | |
|---|---|---|---|
| 884,749 | 4/1908 | Mason . | |
| 2,360,831 | 12/1942 | Proctor . | |
| 2,437,632 | 3/1948 | Wolfram . | |
| 2,471,658 | 5/1949 | Shafter et al. . | |
| 2,747,899 | 5/1956 | Wiltse . | |
| 3,222,089 | 12/1965 | Otteman . | |
| 3,250,331 | 5/1966 | Boyle . | |
| 3,273,646 | 9/1966 | Walker | 166/124 X |
| 3,341,227 | 9/1967 | Pierce . | |
| 3,404,736 | 10/1968 | Nelson et al. | 285/142 X |
| 3,468,558 | 9/1969 | Ahlstone | 285/142 X |
| 3,468,559 | 9/1969 | Ahlstone | 285/18 |
| 3,489,436 | 1/1970 | Ahlstone | 285/18 |
| 3,492,026 | 1/1970 | Ahlstone | 285/18 |
| 3,528,686 | 9/1970 | Nelson | 285/18 |
| 3,540,533 | 11/1970 | Morrill | 166/387 X |
| 3,661,206 | 5/1972 | Patch et al. | 285/315 X |
| 3,664,689 | 5/1972 | Hanes | 285/18 |
| 3,800,869 | 4/1974 | Herd et al. | 166/337 |
| 3,809,158 | 5/1974 | Bonds et al. | 285/18 X |
| 3,827,488 | 8/1974 | Piazza et al. | 285/18 X |
| 3,895,831 | 7/1975 | Fisher . | |
| 3,903,965 | 9/1975 | Ahlstone | 285/18 X |
| 3,918,747 | 11/1975 | Putun | 285/18 X |
| 4,019,579 | 4/1977 | Thuse | 285/18 X |
| 4,046,405 | 9/1977 | Bonds | 285/141 |
| 4,109,942 | 8/1978 | Morrill | 285/340 |
| 4,124,233 | 11/1978 | Ahlstone . | |
| 4,138,144 | 2/1979 | Pierce | 285/18 |
| 4,324,422 | 4/1982 | Rains . | |

*Primary Examiner*—Dave W. Arola

*Attorney, Agent, or Firm*—Ned L. Conley; David Alan Rose; William E. Shull

[57] ABSTRACT

The holddown and packoff apparatus is disposed on the shoulder of a hanger suspending casing in a well. The shoulder engages a seat in the bore of a wellhead. An expansible metal ring is slideably disposed on the hanger shoulder for engagement with an annular groove in the wellhead. A stop ring is insertable behind the expansible ring to expand and positively hold the expansible ring into holddown engagement in the wellhead groove. An independent sealing assembly is disposed on the stop ring and has one seal for the outer surface of the hanger and another seal for the inner surface of the wellhead. The seals operate in series whereby the sealing engagement of one does not hinder the sealing engagement of the other.

20 Claims, 10 Drawing Figures

HOLDDOWN AND PACKOFF APPARATUS

TECHNICAL FIELD

This invention relates to underwater casing hanger apparatus, and more particularly, to holddown apparatus for locking within a wellhead a casing hanger suspending a string of casing or tubing and to packoff assemblies for sealing the annulus between the suspended string and the wellhead.

BACKGROUND OF THE ART

In the drilling of an underwater oil and gas well, it is common to install a series of coaxial casing assemblies extending into the ocean floor to different depths and suspended by a casing hanger mounted at the mudline within the wellhead or a hanger head disposed within the wellhead. An inner hanger apparatus will have a first device for automatically engaging a second device on the wellhead or an outer hanger head, as the case may be, during the time such inner hanger, suspending a string of tubing or casing, is being lowered into the well and so as to prevent further downward movement of such inner hanger and string. Such hanging means may include spring operated latches as the first device for cooperating with grooves as the second device, as shown in U.S. Pat. No. 3,800,869; or, may include a generally downwardly facing seat as the first device for resting on a generally upwardly facing seat as the second device, as shown in U.S. Pat. No. 3,809,158.

In such installations, pressure control equipment is connected to the upper end of the wellhead, and the string is lowered into the well through such equipment for suspension from the wellhead. To lower the string, the hanger, connected to the upper end of the casing or tubing string, has means thereon for releasable connection to a running tool suspended from the lower end of a pipe string extending to the surface, and, as discussed above, a seat thereabout for landing on a seat in the bore of the wellhead as it is lowered by the tool, the coaxial casings forming an annulus.

Although reliance may be had on the weight of the casing or tubing to hold the hanger down within the well after it has landed, generally it is desirable to lock the hanger and string. Conventionally, means for locking the respective casing hangers in the wellhead housing are carried by the wellhead or outer hanger head and automatically interlock with an inner hanger when the inner hanger is landed within the wellhead. U.S. Pat. No. 3,528,686 discloses such an apparatus where the inner hanger has a downwardly facing tapered seat adapted to engage the upwardly facing seat on the surrounding head. Above the hanger seat is a reduced external diameter portion providing an upwardly facing shoulder adapted for engagement with the lower end of a lock ring mounted within an internal groove in the head. As the hanger moves past the lock ring housed in the groove, the lock ring is cammed outwardly into the groove. After the hanger moves past the groove, the locking ring contracts partially inward and above the hanger shoulder to lock the hanger in place and prevent its upward movement.

Various prior art patents disclose means for locking a hanger down within the wellhead including U.S. Pat. Nos. 3,273,646; 3,404,736; 3,468,558; 3,468,559; 3,489,436; 3,492,026; 3,528,686; 3,664,689; 3,800,869; 3,827,488; and 3,918,747. However, most prior art devices do not provide for a positive holddown where the locking ring or latch is prevented from expanding or contracting so as to unlock the hanger within the well. Those which provide a type of positive holddown are in combination with a seal assembly where the positive holddown is not effected until the seal assembly is actuated. Such holddowns are then dependent upon the life of the seal ring in the assembly. See, for example, U.S. Pat. Nos. 3,404,736; 3,540,533; 3,664,689; 3,809,158 and 4,138,144.

Under some circumstances, it is desirable not to lock down the hanger or to have the hanger unlocked. This desirability does not always evidence itself until after the previously installed hanger head has been run and set in place. As a result, if the lock ring is present in the previously installed hanger head, the next hanger therefore will automatically be locked in place upon landing, even though it is later determined that locking is undesirable at that time. U.S. Pat. No. 3,664,689 avoids this problem by installing an optional filler ring around the inner hanger to prevent the locking ring from engaging the hanger shoulder so as to lock down the hanger. The '689 patent still has the disadvantage that the hanger must be pulled from the well to later lock the hanger down.

Most prior art holddown latches include a sealing assembly which is subjected to the deleterious effects of the circulating cement and returns during the cementing operation. See, for example, U.S. Pat. Nos. 3,404,736; 3,528,686; 3,540,533; 3,664,689; 3,809,158; 3,827,488; and 3,918,747. This is true even where the holddown assemblies are independent of the seal assemblies. See U.S. Pat. No. 3,468,558; 3,468,559; 3,489,436; 3,492,026; and 3,827,488. Although U.S. Pat. No. 3,273,646 does not subject its sealing assembly to circulation, neither does it provide a positive holddown during the cementing operation.

The cementing operation includes anchoring the hanger and string in place by means of the cement which is conducted downwardly through the handling string and upwardly into the annulus between the suspended string and the well bore. There are flow passages through the hanger which connect the annulus with the bore of the wellhead above the seat so that returns may be taken up through the flow passages.

The cementing of a casing string within a wellhead structure is a difficult operation that is both costly and time consuming. Among the difficulties is the problem of insuring a solid cementing operation of the casing string within the incased portion of the hole and still providing a reliable means of effecting a secondary seal at the hanger. Many cementing systems operate on a volumetric basis wherein a predetermined amount or volume of cement is pumped into the well and allowed to flow up around the casing string to permanently secure it in place. However, leaks or cracks in the wellhead structure or ruptured strata of the hole itself may drain off a portion of the cement thereby preventing an adequate cementing of the casing. Should this crack or leak occur near the bottom of the hole, virtually all the cement may be drained off or lost from the annulus around the casing, thereby putting greater reliance on the secondary seal at the hanger to prevent any leakage of down hole pressure.

Prior cementers using a return line for logging the height of the effective cement created still further problems. Cement was pumped down into the casing, out the bottom and into the annulus around the casing. To permit the cement to enter the return line or flow past the cementer, the cementer or casing hanger had to be raised up a sufficient distance to provide a flow path thereabout. When sufficient cement had passed the cementer, the cementer was allowed to settle back down to its intended position. The high specific gravity of liquid cement many times buoyed up the casing hanger and prevented it from reassuming its correct position. Therefore, this process was not positive with the high probability that the casing string was not at the bottom of the well hole.

In some cases it is desirable to reciprocate, or repeatedly raise and lower, the casing during the cementing operation to increase the turbulance of the cement for a more complete cleanout of foreign material from the surfaces being cemented. After cementing, the hanger should be lowered to its seat and locked down during solidification of the cement. Therefore, proper completion of the well requires that the annulus formed by adjacent casings, be sealed off above the cement line after the cement has been forced into the annulus. Such a seal has been effected in the prior art by packoff assemblies that include a compressed seal element. See, for example, U.S. Pat. Nos. 3,273,646; 3,404,736; 3,468,558; 3,468,559; 3,489,436; 3,492,026; 3,528,686; 3,664,689; 3,800,869; 3,827,488; 3,918,747; 4,109,942; and 4,138,144. Such patents show a packoff assembly with a seal element disposed between an upper compression member and a lower compression member. In those disclosures, it can be seen that as a load is placed on the packoff assembly, downward movement of the lower compression member will eventually be precluded by stop means. By continuing the downward movement of the upper compression member, the seal element is compressed, thereby expanding to seal against the hanger and head, thus sealing off the annulus.

Sealing off the cemented annulus around the casing is difficult in prior devices because the abrasive effect of liquids and solids displaced by cement sometimes rips or damages the seals, thereby preventing an effective seal. Furthermore, when seals are forced across threaded portions of the casing hanger, additional ripping, tearing or damage of the seals can occur.

U.S. Pat. No. 3,404,736 discloses an integral support ring/packoff assembly. This assembly includes an upper tubular member and a lower tubular member which are made up with one another by means of threads disposed about the upper end of the lower member and threads disposed about an intermediate portion of the upper member. The lower member has threads about its lower end for making up with intermediate threads on the hanger located above the annular seat supporting the hanger within the wellhead and below the running tool threads. The running tool threads are arranged radially inwardly on the hanger so that the lower tubular member is free to move downwardly over the running tool threads on the hanger and into position for engagement with the intermediate threads on the hanger.

The upper member is releasably attached to the running tool by means of pins projecting outwardly from the running tool for fitting within grooves about the upper end of the upper tubular member. These pins not only permit the entire assembly to be lowered onto the casing hanger, but also permit it to be rotated for anchoring thereto by the engagement of the intermediate hanger threads. The upper and lower tubular members are releasably connected against rotation related to one another by means of one or more shear pins so that a right-hand torque transmitted on the running tool by the drill string will be transmitted to the upper member and thus to the lower member for making up the intermediate threads on the hanger.

There is a frustoconical shoulder around the outer circumference of the lower tubular member positioned so as to be opposite an internal groove in the bore of the wellhead. There is a rigid split ring disposed above the shoulder on the lower member for radial expansion into the annular groove. An expander ring, which also functions as a lower compression ring for the seal assembly, has a cooperative tapered surface engaging a taper on the upper surface of the split ring where upon the downward movement of the expander ring, the split ring is expanded radially outwardly into the annular groove to relieve the axial load of the hanger and string on the wellhead.

The seal assembly includes the expander ring as the lower compression member and a seal ring mounted around the lower tubular member and located above the expander ring. On top of the seal ring is an anti-friction ring whose upper surface engages the lower end of the upper tubular member.

To actuate the assembly, a right-hand torque is placed on the running tool causing the upper tubular member to move downwardly thereby expanding the split ring and energizing the seal ring. However, as has been pointed out, there is no positive holddown during the cementing operation and the support provided by the split ring is dependent upon the life of the seal ring. Further, it should be noted that the purpose of the split ring is not to serve as a holddown but as an axial support to relieve part of the load on the hanger.

The prior art packoff assembly requires the dual sealing engagement of both the hanger and the wellhead. Should the packoff assembly fail to be centered within the annular recess formed by the hanger and the wellhead, the sealing assembly may engage only one of the sealing surfaces. This may result from the sealing element failing to sufficiently expand in one of the radial directions to contact a sealing surface.

The device of the present invention includes a positive holddown independent of the packoff assembly. The positive holddown may be actuated for locking or unlocking any time between the loading of the hanger and the actuation of the packoff assembly. Such versatility is lacking in the prior art. Further, the present invention provides a positive holddown whereby the locking ring is locked into the wellhead groove and has no ability to expand or contract so as to become unlocked.

The independent packoff assembly of the present invention can be installed and the cemented annulus can then be selectively sealed off, after the proper cementing job has been performed. The sealing means of the packoff assembly is never subjected to the abrasive effect of the fluid cement and is never forced across threads of other surfaces which may damage or have a deleterious effect on such sealing means. Such sealing means may then act as an effective, reliable, positive secondary seal supplementing the seal provided by the cemented annulus. The packoff assembly of the present invention operates in series whereby an inner sealing means sealingly engages the hanger independently of an outer sealing means engaging the wellhead.

Other objects and advantages of the invention will appear from the following description.

DISCLOSURE OF THE INVENTION

The present invention includes a positive holddown and seal assembly for a hanger. The hanger suspends a string of casing or tubing into a well. A shoulder on the hanger engages a seat in the bore of the wellhead and has passages therethrough for connecting the annular spaces above and below the seat.

The positive holddown includes a rigid, radially expansible locking ring having an upwardly facing tapered surface, and a cam ring having an annular tapered surface for camming cooperation with the locking ring surface. The locking ring is disposed on the hanger shoulder opposite an internal groove in the wellhead. The cam ring threadingly engages the hanger whereby upon rotation, the cam ring moves downwardly on the hanger threads and cams the locking ring outwardly into the wellhead groove.

The seal assembly is disposed in the upper annular space around the hanger to close the annulus. The assembly includes a first tubular body threadingly connectable to the hanger, an outer load ring, an inner load ring, an inner packing ring disposed between the outer load ring and inner load ring, an inner retainer ring, and an outer packing ring disposed between the inner load ring and inner retainer ring. The inner packing ring singly engages the hanger and the outer packing ring singly engages the head. Such sealing occurs in series.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
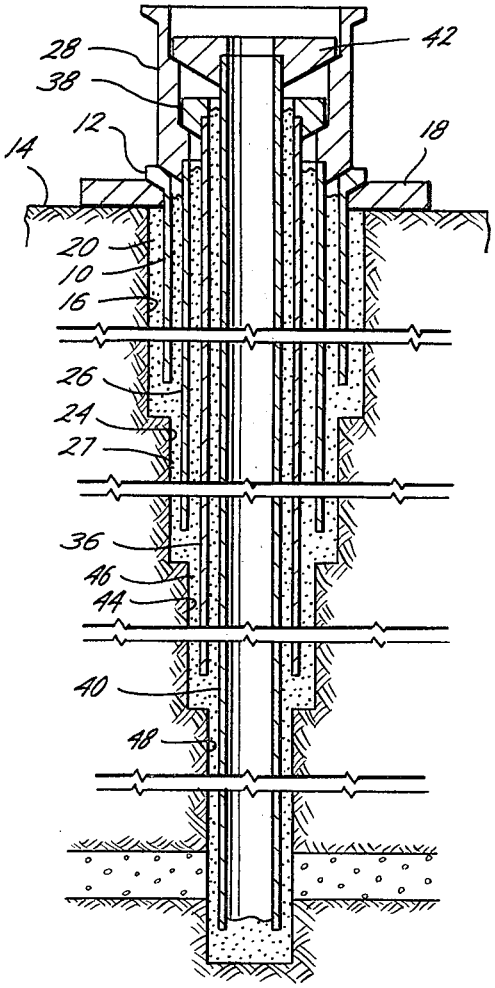
FIG. 1 is a schematic view of the cross section of suspended coaxial casing assemblies in an underwater well.

The present invention is an apparatus for locking within a wellhead a casing hanger suspending a string of casing or tubing and for sealing off the annulus between a casing hanger and a casing head in an oil and gas well. Although the present invention may be used in a variety of environments, FIG. 1 illustrates the environment of the present invention installed in an offshore well on the ocean floor. Such installations ordinarily include a series of coaxial assemblies including casing extending into the ocean floor supported by casing hangers mounted within a wellhead or casing head disposed on a base at the mudline.

Referring now to FIG. 1, a conductor casing 10 and head 12 have been lowered from a drilling means (not shown) such as a barge or bottom-supported platform and installed into the ocean floor 14. The conductor casing may be driven or jetted into the ocean floor 14 until head 12 rests near the mudline, or if the bottom conditions so require, a bore hole 16 may be drilled for the insertion of conductor casing 10. A base structure 18 secured about the upper end of conductor casing 10 rests on the ocean floor 14, and the conductor casing 10 is enclosed within bore hole 16 by a column of cement 20 about at least a substantial portion of its length. A riser (not shown) clamped to head 12 extends from head 12 to the drilling means (not shown).

After drilling apparatus is lowered through the riser and conductor casing 10 to drill a new bore hole 24, surface casing 26, having a wellhead housing 28 attached to its upper end, is lowered through the riser and conductor casing 10 until housing 28 lands on head 12. Surface casing 26 has its lower end anchored within the well by cement 27. Casing head or wellhead housing 28 may be of various designs such as for suspending casing hangerheads which support other casing hangerheads or for supporting multiple casing hangers such as are shown in FIG. 1.

Pressure control equipment is releasably connected to the well either at the ocean floor or at the surface. When located at the surface, the equipment is mounted to the riser extending from the upper end of wellhead housing 28. When located at the ocean floor, the equipment (not shown) is connected directly to the upper end of wellhead housing 28, and has a riser (not shown) extending upwardly to the water's surface. Assuming the latter, such pressure control equipment includes one or more blowout preventors and forms a continuous bore of substantially the same diameter as the upper end of the bore of the wellhead housing 28. The details of the pressure control equipment and its riser are not important to the novel aspects of the present invention and therefore are not described in detail. It is sufficient to note that one or more casing strips may be lowered into and landed within wellhead housing 28 for suspension within the well, as hereinafter described while maintaining pressure control over the well.

Referring again to FIG. 1, intermediate casing 36 with casing hanger 38, and production casing 40 with casing hanger 42, are successively installed within the well. Bore hole 44 is first drilled into the ocean floor within which intermediate casing 36 is lowered and cemented as at 46 and then bore hole 48 is drilled for suspending and cementing production casing 40. Casing hanger 38 and casing hanger 42 are individually supported by wellhead housing 28.

Thus, the series of coaxial casing assemblies are installed in the well beginning with the outermost or conductor casing 10 and concluding with production casing 40. Generally, the installation includes drilling a bore hole having a diameter slightly greater than the casing to be installed and lowering the casing string from the drilling means through a riser and the previously installed casing and into the newly drilled bore hole. The casing is suspended from the wellhead housing by the casing hanger and the casing is anchored within the well by the cement.

One or more tubing strings would subsequently be installed inside the production casing if the well is out into production, and would be suspended and sealed using a tubing hanger and one or more packers to isolate the producing zone from one another. An assembly of production valves would then be connected to wellhead housing 28 in place of the pressure control equipment to control flow from the well.

Having now described the general environment of the present invention, it is now necessary to describe the cementing operation. It should be understood that a description of the cementing of one casing string will be illustrative of the method of cementing the other casing strings and therefore the following detailed description of the cementing of the intermediate casing 36 will be exemplary of that operation for surface casing 26 and production casing 40.

Figure 2:
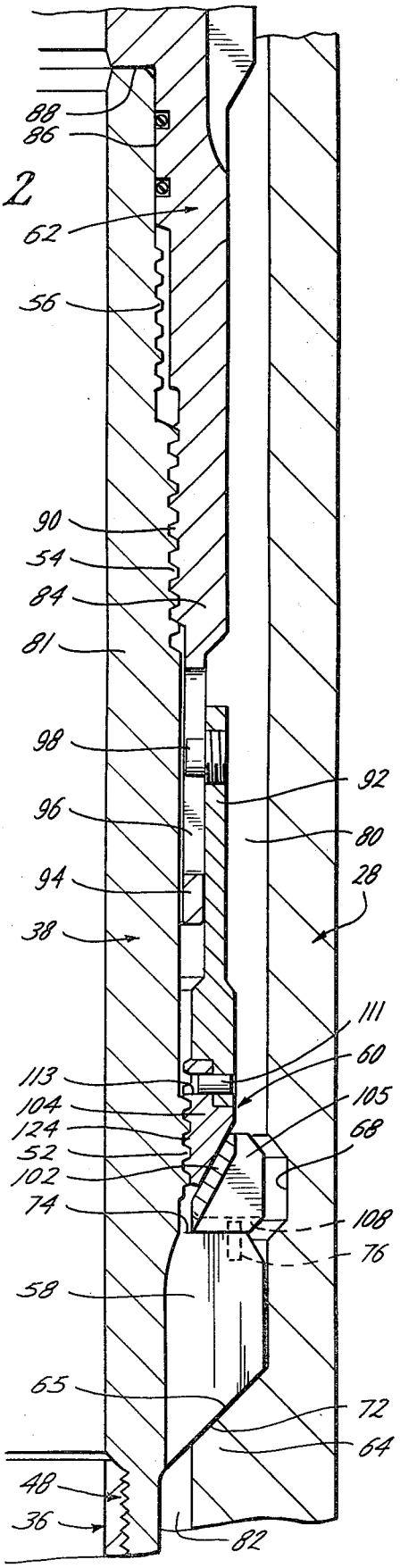
FIG. 2 is a section view of a portion of the hanger, head, running tool, and holddown assembly for the underwater well of FIG. 1.
Figure 2A:
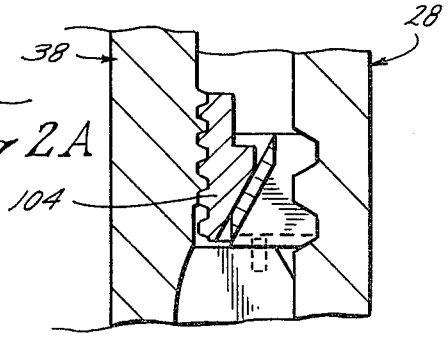
FIG. 2A is a section view of a portion of FIG. 2 illustrating a wellhead groove and locking ring having cooperable plural external frustoconical load-bearing surfaces.

Referring now to FIG. 2, wellhead housing 28 includes an internally projecting annular shoulder 64, forming a lower conical seat 65 having a generally upwardly facing ridge surface, and an annular holddown groove 68 spaced a predetermined distance above shoulder 64. Groove 68 may have a single upper and lower external frustoconical load-bearing surface or a plurality of upper and lower external frustoconical load-bearing surfaces as shown in FIG. 2A. A plurality of such surfaces is often necessary on some wellheads where very high blowout forces can exist. Hanger 38 includes a mandrel 81 having a threaded box at 48 at its lower end for threaded connection to the upper end of casing string 36. Above box 48, hanger 38 has a plurality of azimuthally-spaced ribs 58 formed by flow passages or flutes 70, shown in FIG. 3. The lower annular surface of ribs 58 forms an upper conical seat 72 adapted to engagingly mesh with lower conical seat 65 of shoulder 64.

Figure 3:
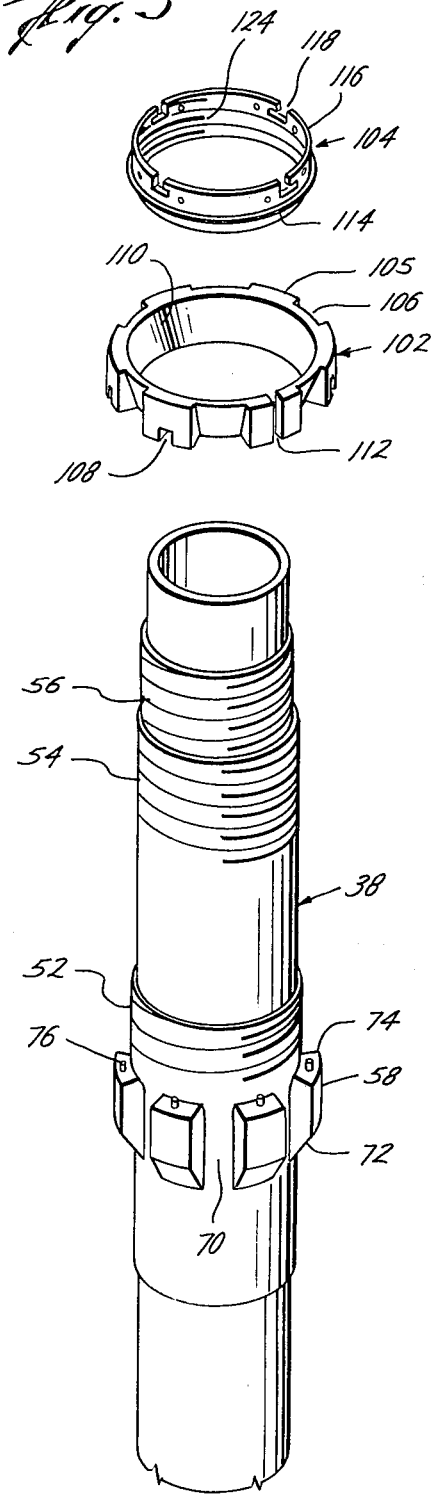
FIG. 3 is a perspective view of the hanger and the holddown assembly of the running tool of FIG. 2.

Referring now to FIGS. 2 and 3, ribs 58 also form an annular shoulder 74, each having an upwardly projecting pin 76. Hanger 38 includes right-hand threads 52 just above ribs 58 for effecting holddown assembly 60, described below, left-hand threads 54 above threads 52 for threaded engagement with running tool 62, also described below, and right-hand threads 56 above threads 54 for connection with a riser (not shown).

Running tool 62 includes a tubular body 84 having a counterbore 86 at its lower end. Counterbore 86 creates an internal annular shoulder 88 acting as a stop for engagement with the upper terminal end of hanger 38 and houses internal threads 90 about its midportion for connection to mating threads 54 on the exterior of hanger 38.

During installation, casing hanger 38, having surface casing 36 suspended from its lower end, is lowered by running tool 62, shown in FIG. 2, and seat 72 of ribs 58 are landed on seat 65 of inwardly projecting annular shoulder 64 in the bore of wellhead housing 28. With casing hanger 38 so landed, casing string 36 is suspended within surface casing 26 and bore hole 44 in spaced relation thereto creating an annulus thereabout which extends from the bottom of bore 44 to the surface. The annulus above flutes 70 formed by running tool 62 and wellhead housing 28 shall be defined as the upper annulus 80 and the lower annulus 82 shall be the annulus below flutes 70.

The physical dimensions of hanger 38 and wellhead housing 28 and their various components is such that when seats 65, 72 engage, shoulder 74 will be approximately even with the lower portion of groove 68 in wellhead housing 28, and there will be a substantially clear passage from the upper annulus 80 above ribs 58 to the lower annulus 82 below ribs 58 through flow passages 70.

Hanger holddown assembly 60 is lowered into the well on hanger 38 with running tool 62 and may be actuated, as will be described hereinafter in detail, by a right-hand torque applied to the running tool drill string and transmitted to assembly 60. Upon actuation, assembly 60 positively locks seat 72 of ribs 58 against annular seat 65 of shoulder 64 on wellhead housing 28 thereby preventing the upward movement of hanger 38. Since the threads of the couplings comprising the running tool drill string are right-hand threads, the applied right-hand torque will not loosen such threads.

The present invention permits holddown assembly 60 to be actuated at will. In some cases it is desirable to reciprocate the casing during the cementing operation to increase the turbulance of the cement for a more complete clean-out of foreign material from the surfaces being cemented to obtain a better bond. Thus, it is an advantage to be able to latch the hanger down before, during, or after the cementing operation. As can be best visualized from FIG. 1, the drill pipe (not shown) extends from the casing hanger 38 to the surface so that cement may be pumped downwardly through the drill pipe and through casing 36 around the lower end of casing 36 and upwardly within lower annulus 82 around the exterior of casing 36. During the cementing operation, returns are taken upwardly through lower annulus 82, through flow passages or flutes 70, and into upper annulus 80.

Upon rotation of the running tool drill string after complete actuation of holddown assembly 60, shear means 111 shown in FIG. 2 disengages assembly 60 permitting it to continue to maintain positive holddown after disengagement of running tool 62. Threads 54 and 90 are left-hand threads so that right-hand rotation disengages handling tool 62 from hanger 38. In this manner after completion of the cementing operation, sufficient predetermined right-hand rotation detaches running tool 62 from hanger 38 and running tool 62 is withdrawn from wellhead housing 28. A seal assembly or packoff 100, hereinafter described in detail, is then lowered through the riser and onto mandrel 81 into annulus 80 for closing and sealing flow passages 70. The seal assembly 100 is lowered by means of another running tool suspended from the lower end of a drill string. In summary, the hanger holddown 60 holds hanger 38 down against wellhead housing 28 and the packoff assembly 100 seals off upper annulus 80 from lower annulus 82 closing flow passages 70. It is an especially desirable feature that the holddown operate entirely independent of the packoff assembly 100. Although the invention has been described as being installed and the holddown effected before the packoff is even run into the well, it should be understood that the holddown and packoff may be adapted to be combined and lowered into the well as a unit and be used together.

Referring now to FIG. 2, running tool 62 includes a tubular body 84 and a torque sleeve 92. Body 84 has an upper threaded box (not shown) in which the handling string is received and a lower threaded box having left-hand threads 90 which engage threads 54 of hanger 38. Torque sleeve 92 is telescopically received over a reduced diameter portion 94 at the lower end of body 84. Reduced diameter portion 94 includes vertical slots 96 for receiving torque pins 98 passing through the upper end of torque sleeve 92 and projecting into slots 96. Hanger holddown assembly 60 is mounted on the lower end of torque sleeve 92 whereby the reciprocal movements of pins 98 within slots 96 permit a vertical movement of hanger holddown assembly 60 with respect to running tool 62 and casing hanger 38.

Referring to FIGS. 2 and 3, holddown assembly 60 includes a latch ring 102 and locking ring 104. Latch ring 102 rests on the upper shoulder 74 of ribs 58 of hanger 38 and has ribs 105 defined by bypass grooves 106 which correspond to flow passages 70 of hanger 38. Each rib 105 has a radially-extending slot 108 on its lower surface for receiving pin 76 on each corresponding rib 72 of hanger 38 to prevent rotation of ring 102 with respect to hanger 38. Latch ring 102 further has a bevelled inner surface 110 and is split at 112 to permit expansion.

Locking ring 104 has internal right-hand threads 124 for threaded engagement with threads 52 of hanger 38. Ring 104 also includes shear pins 111 received by mating apertures 113 in the lower end of torque sleeve 92. A lower bevelled outer surface 114 on ring 104 meshes with bevelled inner surface 110 of latch 102. In this way, as locking ring 104 is tightened onto threads 52 by right-hand rotation, locking ring 104 moves downwardly causing mating cam surfaces 110, 114 to expand latch ring 102 radially, rotation of latch ring 102 being prevented by pins 76. Thus, when hanger 38 is positioned with respect to wellhead housing 28 as shown in FIG. 22, as locking ring 104 is tightened onto threads 52, latch ring 102 is expanded into groove 68 of housing 28 thereby holding hanger 38 down with respect to housing 28. Locking ring 104 further includes upwardly projecting annular flange 116 having a plurality of azimuthally-spaced J-slots 118 which may be engaged by a tool for ultimately releasing and removing the holddown assembly 60.

According to the operation of the holddown assembly 60 of FIGS. 2 and 3, hanger 38 is attached to the top of casing 36, latch ring 102 is placed over hanger 38 and rested on shoulder 74 of ribs 58 of hanger 38. Locking ring 104 is installed onto threads 52 by right-hand rotation and running tool 62 is threaded onto hanger 38 by left-hand rotation. Sleeve 92 is pinned to ring 104 by shear pins 111. The handling string is threaded into upper-threaded box of body 84 of running tool 62. Hanger 38 is then lowered by means of the handling string until seat 72 of ribs 58 rest on seat 65 of shoulder 64 of wellhead housing 28. The handling string is then rotated in a right-hand direction causing locking ring 104 to thread onto threads 52 whereby latch ring 102 is cammed into groove 68 and hanger 38 is positively held down against wellhead housing 28. When locking ring 104 is threaded onto threads 52 to the maximum extent, shear pins 111 will shear, thus disconnecting running tool 62 and holddown assembly 60. During the time that locking ring 104 is being threaded onto right-hand threads 52, running tool 62 is threading off of left-hand threads 54. As right-hand rotation of the handling string continues, running tool 62 will eventually be threaded free of hanger 38 at which time the handling string and running tool 62 are raised from the well.

Holddown assembly 60 may be actuated prior to cementing casing 36 to insure a positive holddown before, during, and after the cementing operation. An independent holddown assembly without the seal assembly avoids subjecting the seal assembly to deterioration caused by the flow of cement in annulus 80. In prior art apparatus, the seal assembly was either subjected to the cement, or the holddown assembly and seal assembly were lowered into the well after completing the cementing operation during which there was no postive holddown. A positive holddown is defined as a latch ring biased into engagement with a corresponding groove whereby the latch ring cannot be retracted by downhole pressure. Bypass grooves 106 of latch ring 102, flow passages 70 of hanger 38, and bypass grooves 96 of running tool 62 permit the relief of pressure from annulus 82 during the cementing process.

Figure 4:
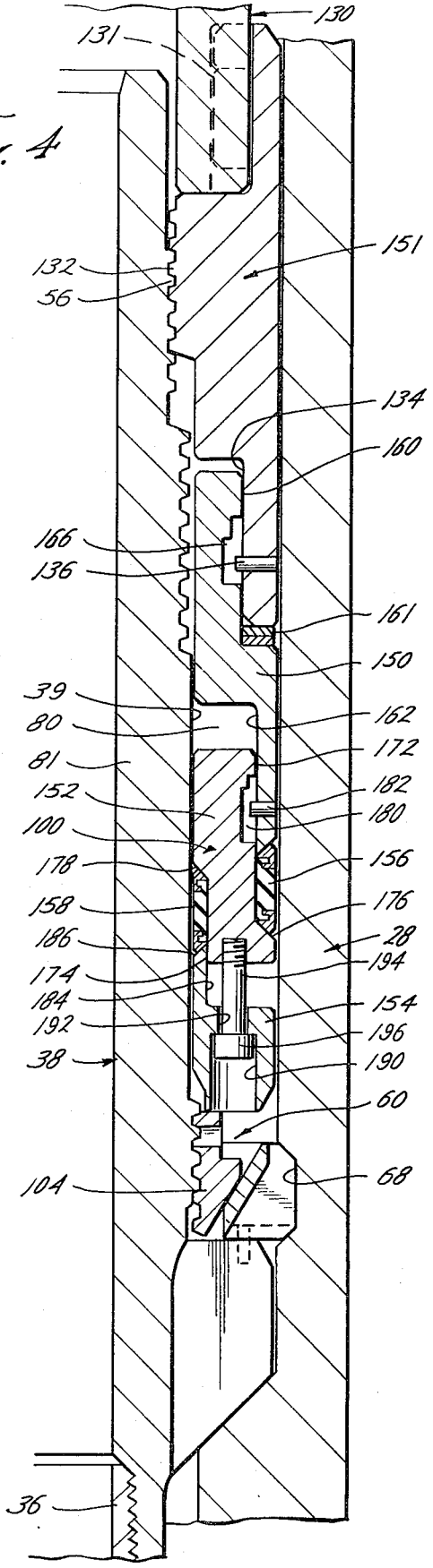
FIG. 4 is a section view of a portion of the hanger, head, running tool, and seal assembly for the underwater well of FIG. 1.

Referring now to FIG. 4 for a description of packoff assembly 100, after the cementing operation has been completed and running tool 62 has been removed, packoff assembly 100 is lowered into the well on running tool 130 to seal annulus 80 just above groove 68 in wellhead housing 28. Packoff assembly 100 includes an outer load ring 150, an actuating ring 151, inner load ring 152, inner retainer ring 154, outer packing ring 156, and inner packing ring 158.

Figure 5:
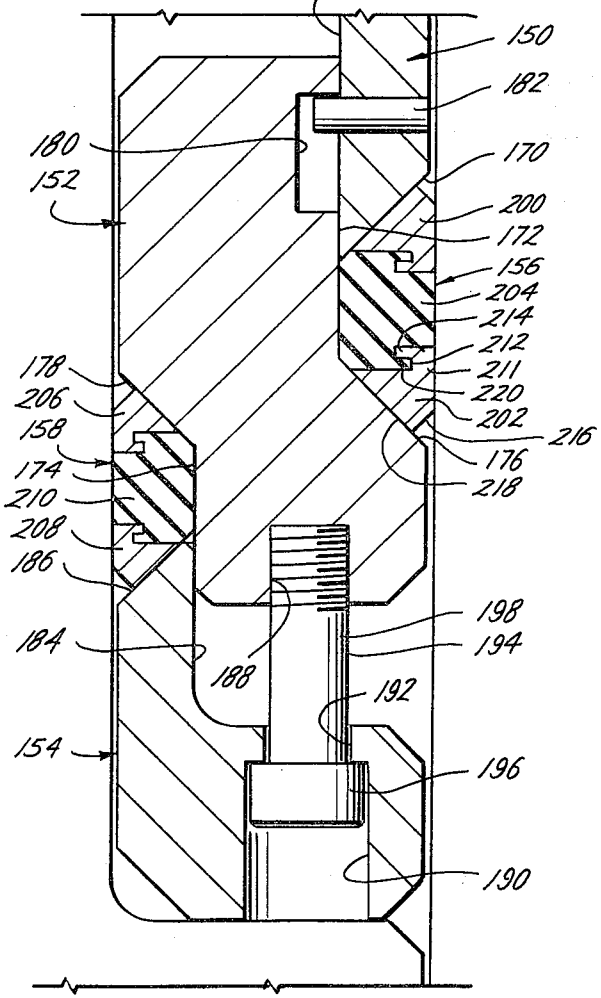
FIG. 5 is an enlarged section view of the seal assembly of FIG. 4.

Outer load ring 150 includes a reduced diameter portion 160 around its upper end and a counterbore 162 in its lower end. Actuating ring 151 has a counterbore 134 in its lower end for receiving reduced diameter portion 160 of outer load ring 150, and an internal J-slot 131 in its upper end to receive running tool 130. Bearing rings 161 are received by reduced diameter portion 160 to reduce friction with the lower end of actuating ring 151. Outer load ring 150 has an annular groove 166 which receives a plurality of pins 136 projecting through the internal wall of counterbore 134 of actuating ring 151. Outer load ring 150, and thus packing assembly 100, is mounted onto the lower end of actuating ring 151 by means of the engagement of pins 136 with the upper horizontal wall of annular groove 166 in ring 150. As best illustrated in FIG. 5, the lower terminus 170 of outer load ring 150 has a forty-five degree chamfer creating a downwardly and outwardly facing surface for engagement with outer packing ring 156.

Inner load ring 152 has a reduced diameter portion 172 at its upper end and a counterbore 174 in its lower end. Reduced diameter portion 172 forms a conical seat 176 at a forty-five degree angle with the external axial wall of portion 172. Conical seat 176 forms an upwardly and outwardly facing surface for engagement with outer packing ring 156. Counterbore 174 forms seat 178 having a forty-five degree angle with the internal axial wall of counterbore 174. The conical shoulder 178 has a downwardly and inwardly facing surface for engagement with inner packing ring 158. Reduced diameter portion 172 of inner load ring 152 is received within counterbore 162 of outer load ring 150. Outer load ring 150 and inner load ring 152 are connected together by means of an annular groove 180 in the axial wall of reduce diameter portion 172 of inner load ring 152 which receives a plurality of roll pins 182 projecting from the internal surface of the axial wall of counterbore 162 of outer load ring 150. As can be seen in FIG. 5, groove 180 has an axial length substantially greater than the diameter of pins 182 thereby permitting axial movement of outer load ring 150 with respect to inner load ring 152. The internal diameter of reduced diameter portion 172 of inner load ring 152 is greater than the outer diameter of mandrel 81 and the outer diameter of portion 172 is less than the inner diameter of counterbore 162 of outer load ring 150.

Referring again to FIG. 5, inner retainer ring 154 has a reduced diameter portion 184. The upper end of inner retainer ring 154 includes a conical seat 186 having a forty-five degree angle with the internal axial wall of ring 154, the seat having an upwardly and inwardly facing surface for engagement with inner packing ring 158. Reduced diameter portion 184 is received within lower counterbore 174 of inner load ring 152. Inner load ring 152 and inner retainer ring 154 are connected together by connection means which includes a plurality of downwardly facing countersinks 190 and a plurality of unthreaded passageways 192 through inner retainer ring 154, and a plurality of bolts 194 each having a head 196 disposed within a countersink 190 and a shaft 198 extending through a passageway 192 and threaded into a blind hole 188. The length of reduced diameter portion 184 when inserted into counterbore 174 produces a gap between inner load ring 152 and inner retainer ring 154 to permit axial movement of the compression members with respect to one another.

Referring again to FIG. 5, outer packing ring 156 includes metal rings 200, 202 and seal ring 204, and inner packing ring 158 includes metal rings 206, 208 and seal ring 210. Outer packing ring 156 is disposed between seat 176 on inner load ring 152 and seat 170 on outer load ring 150. Inner packing ring 158 is disposed between seat 186 on inner retainer ring 154 and seat 178 on inner load ring 152. Thus, outer packing ring 156 is compressed between outer load ring 150 and inner load ring 152, and inner packing ring 158 is compressed between inner load ring 152 and inner retainer ring 154.

Outer and inner packing rings 156, 158 are of common design with the exception that inner packing ring 158 has smaller dimensions. Metal rings 206, 208 have smaller cross sections than metal rings 200, 202. The cross sections of rings 206, 208 each have twenty percent less area, thus causing rings 206, 208 to contact the exterior wall of hanger 38 first upon actuation. Metal rings 200, 202 and 206, 208 also act as nonextrusion rings for seal rings 204, 210. Since the metal rings are of common design, it will be seen that a description of one will be a description of the others.

Metal ring 202 of outer packing ring 156 is made of metal to maintain a metal-to-metal seal with wellhead housing 28. Metal ring 202 includes a reduced diameter portion w211 having an annular channel 212 at the base of the axial wall of reduced diameter portion 211 creating annular lip 214. The lower annular corner facing wellhead housing 28 has been chamfered as at 216. Lower annular shoulder 218 contacting seat 176 is bevelled at a forty-five degree angle for engaging seat 176.

The lower chamfered shoulder 216 has eliminated the sharp corner to make it easier to handle, less susceptable to damage, and to increase the loading on the metal-to-metal seal using the same amount of force with less resisting metal. The chamfer at 216 reduces the metal-to-metal contact with the sealing surface of wellhead housing 28 to give a better metal-to-metal engagement.

Rubber seal rings 204, 210 are preferably an elastomer or rubber but may be of graphite or Teflon. Seal rings 204, 210 are backup seals in case the sealing surfaces of hanger 38 or wellhead housing 28 are scratched. These seals also provide resilience and flowability. Seal ring 204 has an opposing annular lip 220 for locking engagement with lip 214 upon the assembly of packing ring 158. The rubber seal rings 204, 210 may be bonded or molded to their respective metal rings 200, 202, 206, 208. The interlocking of the seal rings between the metal rings provides a larger bond area.

Referring now to FIG. 4, packoff assembly 100 is received over and centralized on the neck of hanger 38 and is housed in the bore of wellhead housing 28. The sealing surface 39 of hanger 38 is maintained clean so that a small inner diameter packoff assembly 100 may be used. However, ample inner diameter clearance is provided for assembly purposes and even greater clearance is provided on the outer diameter to avoid damage during remote installation within wellhead housing 28.

Figure 6A:
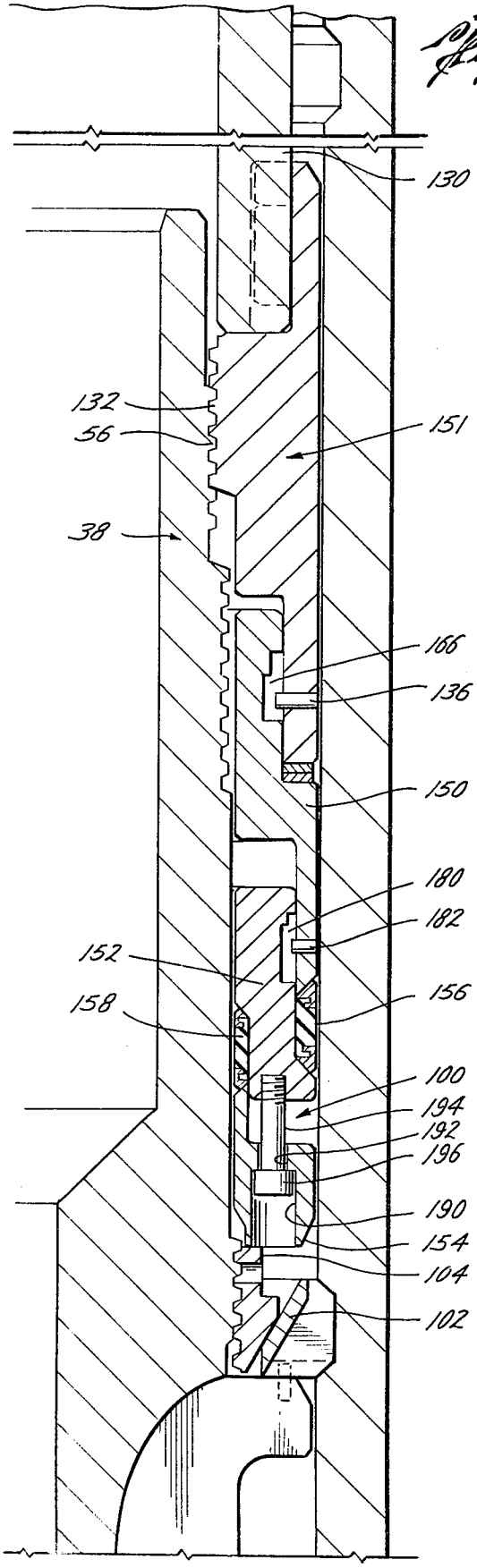
FIG. 6A is a section view of the seal assembly and environment shown in FIG. 4 but in the engaged position.
Figure 6B:
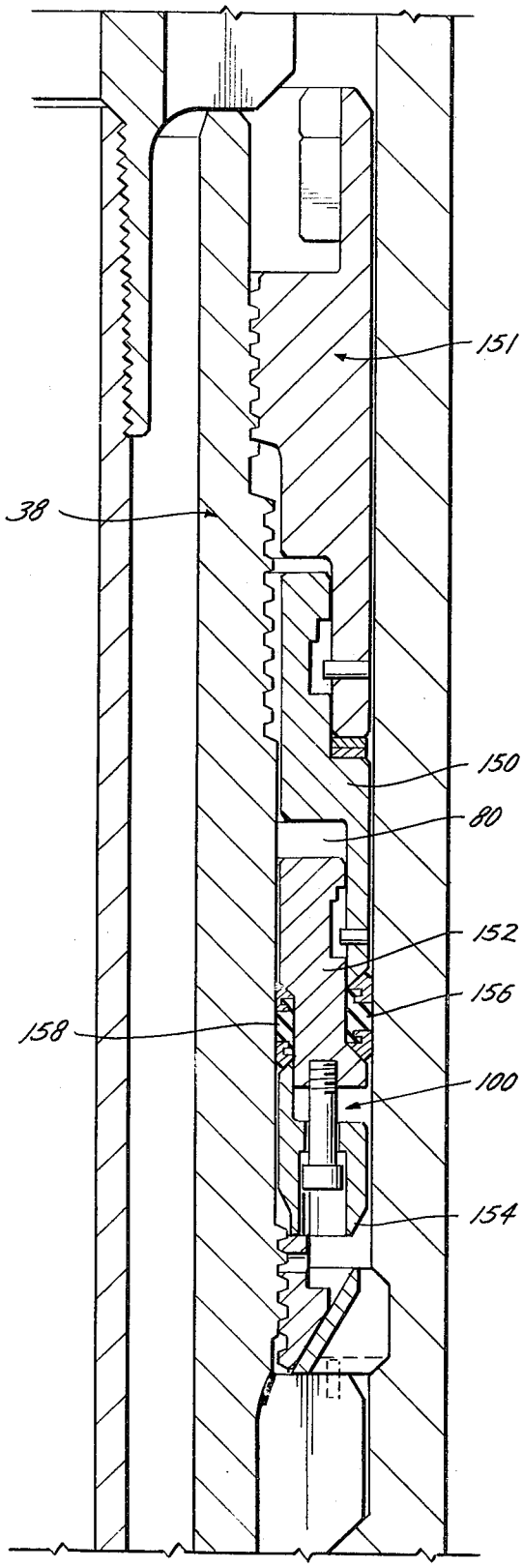
FIG. 6B is an enlarged view of the engaged seal assembly shown in FIG. 6A.

Referring now to FIGS. 6A and 6B showing packoff assembly 100 before and after actuation, the entire packoff assembly 100 is lowered into the well by means of a riser which is connected to running tool 130 which in turn supports packoff assembly 100. As the riser and packoff assembly 100 are lowered into the well, roll pins 136, 182 will bear against the upper surfaces of grooves 166, 180, respectively, and heads 196 of bolts 194 will bear against the upper surface of countersinks 190. In such a condition, packing rings 156, 158 are minimally compressed.

Referring now to FIG. 6A, as actuating ring 151 is threaded onto hanger 38 by threads 132 of ring 151 and upper threads 56 of hanger 38, the lower end of inner retainer ring 154 contacts the upper end of locking ring 104 whereby further axial movement of inner retainer ring 154 is prevented.

Referring now to FIG. 6B, further threading of actuating ring 151 onto hanger 38 causes further axial movement of outer load ring 150 with respect to inner retainer ring 154. Inner packing ring 158 contacts the sealing surface of hanger 38 first and because of its smaller cross section, provides a higher loading per unit area. Metal rings 206, 208 and 200, 202 compress seal rings 210, 204 respectively. Metal rings 206, 208 and 200, 202 also tend to elongate to create a metal-to-metal seal with the sealing surfaces of hanger 38 and wellhead housing 28.

It is important that outer packing ring 156 does not act as a brake during acutation. As can be seen, seal rings 156, 158 are loaded in series, and no additional O-rings are required. There is no potential leak path between the seals. The entire sealing force is applied through the outer diameter and inner diameter seal elements with the lower seal being loaded first. Upon completion of the threading of actuating ring 151 onto hanger 38, the packoff assembly 100 will be fully actuated and the seal of annulus 80 effected.

By virtue of inner load ring 152, the rate of compression of packing rings 156, 158 with respect to one another can vary. As a result, even when one seal assembly is fully compressed, compression of the other seal assembly may continue. In this way, both packing rings can be fully compressed even though the compression characteristics of such packing rings vary in size with respect to one another, and even when one packing ring is required to fill a larger gap than the other.

Figure 7:
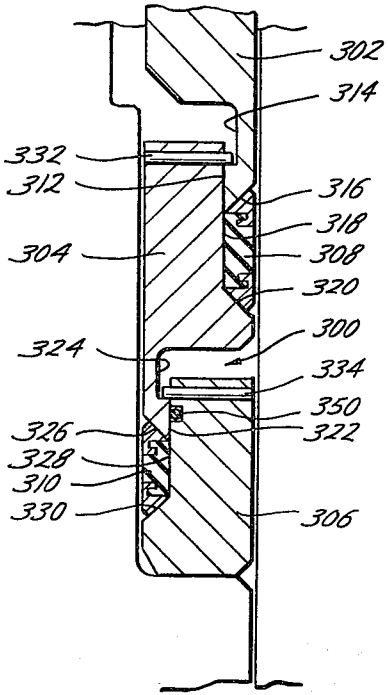
FIG. 7 is a section view of a first alternative embodiment of the seal assembly.

Referring now to an alternative embodiment of the sealing assembly shown in FIG. 7, alternative sealing assembly 300 includes an outer load ring 302, an inner load ring 304, an outer retainer ring 306, an outer packing ring 308 and an inner packing ring 310.

Outer load ring 302 includes a counterbore 312 having an internally facing annular groove 314. The lower tip of outer load ring 302 is bevelled to form a conical seat 316 having a downwardly and outwardly facing surface for engagement with packing ring 308.

Inner load ring 304 includes a reduced diameter portion 318 forming seat 320. Seat 320 has an upwardly and outwardly facing surface for engagement with packing ring 308.

Inner load ring 304 also includes a lower reduced diameter portion 322 having an outwardly facing annular groove 324. The lower tip of inner load ring 304 is bevelled to form a conical seat 326 having a downwardly and inwardly facing surface for engagement with lower packing ring 310.

Outer ring 306 includes a counterbore 328 forming a conical shoulder 330 with an upwardly and internally facing surface for engaging lower packing ring 310.

Inner load ring 304 is connected to outer load ring 302 and outer retainer ring 306 by means of roll pins 332, 334. Pin 332 projects outwardly at the upper end of ring 304 and is received by annular groove 314 in ring 302. Inner retainer ring 306 includes roll pin 334 projecting from its upper end into annular groove 324 in inner load ring 304.

Packing rings 308, 310 each include an upper metal ring, a lower metal ring and a seal ring having basically the same design as those in the preferred embodiment.

Outer retainer ring 306 includes an O-ring 350 to prevent leakage along seat 326.

Figure 8:
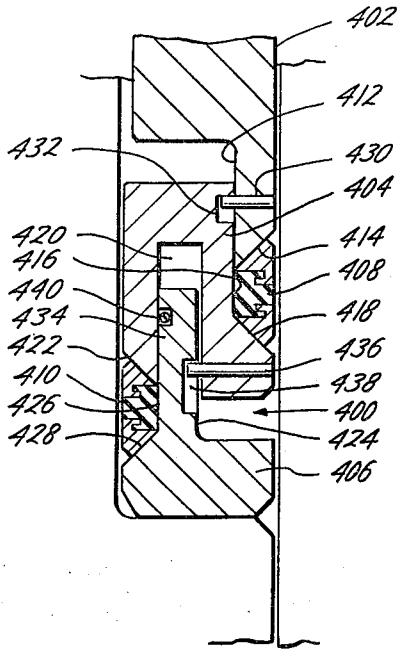
FIG. 8 is a section view of a second alternative embodiment of the seal assembly.

Referring now to FIG. 8 illustrating another alternative embodiment of the packoff assembly, packoff assembly 400 includes outer load ring 402, inner load ring 404, inner retainer ring 406, outer packing ring 408, and inner packing ring 410.

Outer load ring 402 includes a counterbore 412. The lower end of outer load ring 402 has a downwardly and outwardly facing seat 414 for engagement with outer packing ring 408.

Inner load ring 404 includes a reduced diameter portion 416 forming a lower seat 418 having an upwardly and outwardly facing surface for engagement with outer packing ring 408. Inner load ring 404 also includes an annular slot 420. A downwardly and internally facing seat 422 is located on the lower inner corner of inner load ring 404 for engagement with inner packing ring 410.

Inner retainer ring 406 includes a reduced diameter portion 424 and a counterbore 426. Counterbore 426 forms an upwardly internally facing seat 428 for engagement with lower packing ring 410.

Reduced diameter portion 416 of inner load ring 404 is received within counterbore 412 of outer load ring 402. Ring 404 is retained within counterbore 412 by inwardly projecting roll pins 430 received in an annular groove 432 around the axial wall of reduced diameter portion 416 of inner load ring 404. An annular flange 434 is formed by reduced diameter portion 424 and counterbore 426 of inner retainer ring 406. Annular flange 434 is received in annular slot 420 of inner load ring 404. Inner retainer ring 406 is retained in inner load ring slot 420 by inwardly projecting roll pins 436 being received in annular groove 438 around the axial wall of reduced diameter portion 424 of ring 406.

Outer packing ring 408 is captured between seat 414 of ring 402 and seat 418 of ring 404, and inner packing ring 410 is captured between seat 422 of ring 404 and seat 428 of ring 406. The configuration of this alternative embodiment reduces the overall height of the packoff assembly. This is permitted by inner ring 404 being folded over to reduce its overall height.

An O-ring 440 is housed in an annular groove in the axial wall of counterbore 426 to prevent leakage around the upper metal ring of lower packing ring 410.

While a preferred embodiment of the invention has been shown and described, modifications thereof can be made by one skilled in the art without departing from the spirit of the invention.

What is claimed is:

1. A well apparatus for preventing axial movement of a hanger disposed within a head, the head having a bore therethrough and there being an annulus between the hanger and head, and for sealing the annulus between the hanger and head, the hanger having a shoulder thereon and the head having a seat in the bore, the shoulder being supported by the seat, and the head having a holddown groove in the wall of the bore spaced above the seat, comprising:

an expandable ring disposed on a surface of the shoulder on the hanger adjacent the holddown groove in the bore of the head for expanding into holddown engagement with the holddown groove, said ring having a tapered surface;

a locking ring having first connection means connected to the hanger and a tapered surface shaped for camming engagement with said tapered surface of said expandable ring for camming said expandable ring radially outwardly into holddown engagement with the holddown groove when said first connection means is made up;

releasable actuation means for actuating said locking ring into camming engagement with said expandable ring whereby said expandable ring engages the holddown groove to prevent axial movement of the hanger within the head, said actuation means including a body having second connection means connected to the hanger;

a member disposed on said body and engaging said locking ring for transmitting force from said body to said locking ring for making up said first connection means;

cooperable means on said body, member and hanger for disconnecting said second connection means and effecting release of said actuation means as said first connection means is made up, said cooperable means including said first and second connection means being oppositely-handed threaded connections and an axial lost motion connection between said body and said member;

first sealing means disposed in the annulus between the hanger and head above said expandable ring for sealing engagement with the hanger;

second sealing means independent of said first sealing means disposed in the annulus between the hanger and head for sealing engagement with the bore of the head; and compression means having third connection means for connecting to the hanger upon disconnection of said second connection means for compressing said first and second sealing means in series.

2. The apparatus of claim 1 wherein said locking ring includes release means having a slot for permitting said locking ring to be engaged by a tool and moved away from engagement with said expandable ring for permitting said expandable ring to contract into a nonengaging position.

3. The apparatus of claim 4 wherein said locking ring includes means cooperable with said hanger for inserting said locking ring between said annular metal member and said hanger.

4. The apparatus of claim 1 wherein said expandable ring includes an annular metal member having flow passages therethrough.

5. The apparatus of claim 4 wherein said metal member is a rigid split ring having an upwardly facing tapered annular surface.

6. The apparatus of claim 5 wherein said locking ring includes an annular metal ring having a frustoconical shoulder for camming engagement with said tapered surface of said split ring.

7. The apparatus of claim 5 wherein said rigid ring has tapering surfaces corresponding to the surfaces of the upper end of a groove in the head.

8. A well apparatus for preventing axial movement of a hanger disposed within a head, the head having a bore therethrough and there being an annulus between the hanger and head, and for sealing the annulus between the hanger and head, the hanger having a shoulder thereon and the head having a seat in the bore, the shoulder being supported by the seat, and the head having a holddown groove in the wall of the bore spaced above the seat, comprising:

expansible means disposed on the shoulder of the hanger adjacent the holddown groove in the wall of the bore for expanding into holddown engagement with the holddown groove of the head;

cam means having first connection means connected to the hanger for camming said expansible means radially outwardly into the holddown groove for holddown engagement with the head;

second connection means disposed on the hanger adapted for releasable connection to a tool means for actuating said cam means into camming engagement with said expansible means whereby said expansible means engages the holddown groove in the head to prevent axial movement of the hanger within the head;

first sealing means disposed above said expansible means for sealing engagement with the hanger;

second sealing means independent of said first sealing means for sealing engagement with the head;

compression means for sealingly engaging said first and second sealing means in series;

said first sealing means including a first sealing element and two first metal members, said first sealing element being disposed between said two first metal members, and said second sealing means including a second sealing element and two second metal members, said second sealing element being disposed between said two second metal members, the axial projected area of said first sealing element and said first metal members being less than the axial projected area of said second sealing element and said second metal members.

9. The assembly of claim 8 wherein the axial projected area of said first sealing means is sized with respect to the axial projected area of said second sealing means whereby said first sealing means will sealingly engage the hanger before said second sealing means sealingly engages the bore of the head.

10. The assembly of claim 8 wherein said first metal members include first upper and lower metal rings having frustoconical shoulders facing away from said first sealing element and said second metal members include second upper and lower metal rings having frustoconical shoulders facing away from said second sealing element.

11. A well apparatus comprising:

a hanger for suspending a string of pipe into a well, said hanger having a shoulder thereon;

a head having a seat engageable with said shoulder and a ridge disposed above said heat, there being an annular space between the hanger and head;

a metal member slideably engageable with said ridge and said shoulder, the thickness of said shoulder and said metal member being almost equal to the distance that said ridge is disposed above said seat;

a filler member insertable between said metal member and said hanger to prevent said metal member from sliding into nonengagement with said ridge whereby said ridge and said seat encapsulate said metal member and said shoulder therebetween thereby preventing any vertical movement of said hanger with respect to said head;

an inner retainer ring disposed in said annular space above and supported by said filler member;

an inner load ring disposed in said annulr space above and reciprocably connected to said inner retainer ring, said inner load ring having a counterbore around its lower inner surface with a second seat at the upper end of said counterbore, and a reduced diameter portion around its upper outer surface with a third seat at the lower end of said reduced diameter portion;

an outer load ring disposed in said annular space above and reciprocably connected to said inner load ring;

first sealing means disposed in said counterbore between the hanger and the inner load ring and between the upper end of said inner retainer ring and said second seat for sealing engagement with the surface of said hanger;

second sealing means independent of said first sealing means disposed around said reduced diameter portion between said inner load ring and said head and between the lower end of said outer load ring and said third seat for sealing engagement with the bore of said head, one of said first and second sealing means having an axial projected area greater than the other; and compression means for sealingly engaging said first and second sealing means in series.

12. A well apparatus for preventing axial movement of a hanger disposed within a head, the head having a bore therethrough and there being an annulus between the hanger and head, and for sealing the annulus between the hanger and the head, the hanger having a shoulder thereon and the head having a seat in the bore, the shoulder being supported by the seat, and the head having a holddown groove in the wall of the bore spaced above the seat, comprising:

an expandable member disposed on the shoulder of the hanger adjacent the holddown groove for expanding into holddown engagement with the groove in the head;

a locking member engaging said expandable member, said locking and expandable members having cooperable surfaces for said locking member holding said expandable member radially outward into the holddown groove for holddown engagement with the head;

an intermediate tubular member;

a lower tubular member disposed below and reciprocably mounted on said intermediate tubular member;

an upper tubular member disposed above and reciprocably mounted on said intermediate tubular member;

first sealing means disposed above and supported by said lower tubular member and engageable with said intermediate tubular member for sealing engagement with the hanger;

second sealing means independent of said first sealing means disposed on said intermediate tubular member and engageable with said upper tubular member for sealing engagement with the head, the axial projected area of said first sealing means being less than the axial projected area of said second sealing means; and compression means for compressing said lower, intermediate and upper tubular members together, said first and second sealing means sealingly engaging the hanger and head in series whereby said second sealing means may be further compressed between said upper and intermediate tubular members after the compression of said first sealing means between said lower and intermediate tubular members has been completed.

13. The well apparatus of claim 12 wherein said lower tubular member has a skirt received in a counterbore of said intermediate tubular member, said first sealing means being disposed between the end of said skirt and the bottom of said counterbore.

14. The well apparatus of claim 12 wherein said intermediate tubular member has an annular slot and a reduced diameter portion adjacent said slot and said upper and lower tubular members have skirts, the skirt of said upper tubular member receiving said reduced diameter portion and the skirt of said lower tubular member being received by said annular slot.

15. The assembly of claim 12 further including actuation means for applying a force on said compression means for compressing said compression means against said locking member.

16. The well apparatus of claim 12 wherein said first sealing means includes a first sealing element and a plurality of first metal members, said first sealing element being disposed between said first metal members, and said second sealing means includes a second sealing element and a plurality of second metal members, said second sealing element being disposed between said second metal members.

17. The assembly of claim 16 wherein said first and second metal members have frustoconical surfaces, and said lower and intermediate tubular members have tapered surfaces for cooperatively engaging the frustoconical surfaces of said first metal members, and said upper and intermediate tubular members have tapered surfaces for cooperatively engaging the frustoconical surfaces of said second metal members.

18. The assembly of claim 17 wherein said first and second metal members have chamfered annular corners facing the sealing surfaces of the hanger and head.

19. A well apparatus comprising:

a hanger for suspending a string of pipe into a well, said hanger having a shoulder thereon;

a head having a seat engageable with said shoulder and a ridge disposed above said seat;

a metal member slidably engageable with said ridge and said shoulder, the thickness of said shoulder and said metal member being less than the distance that said ridge is disposed above said seat;

a filler member insertable between said metal member and said hanger to prevent said metal member from sliding into non-engagement with said ridge whereby said ridge and said seat encapsulate said metal member and said shoulder therebetween thereby preventing any vertical movement of said hanger with respect to said head;

an annular member disposed around said hanger and above said filler member;

first sealing means including a sealing element disposed between said filler member and said annular member for sealing engagement with said hanger and said annular member;

an actuator member disposed above said annular member;

second sealing means including a second sealing element independent of said first sealing means disposed between said annular member and said actuator member for sealing engagement with said head and said annular member, the axial projected area of said first sealing element being less than the axial projected area of said second sealing element; and compression means for pressing said first sealing means, said annular member, said second sealing means, and said actuator member toward said shoulder causing said first and second sealing means to sealingly engage said hanger and head in series due to the compression load on said first sealing means being transmitted through said second sealing means whereby said second sealing means is further compressed after the compression of said first sealing means is completed.

20. Wellhead apparatus comprising:

a casing head having a bore therethrough with an upper cylindrical portion, said cylindrical portion having a seat at its lower end and an annular groove above said seat;

a casing hanger having a shoulder landable on said seat for suspending a casing string from its lower end;

flow passages connecting annular spaces between said hanger and head above and below the seat;

a holddown assembly disposed on said shoulder for anchoring said casing hanger with said casing head, said holddown assembly including an expandable member adjacent said groove and a camming member connected to said hanger with first connection means, said camming and expandable members having cooperable camming surfaces, said cooperable camming surfaces engaging each other and said camming member camming and expanding said expandable member radially into said groove for holddown engagement with said head upon said first connection means being made up and connecting said camming member to said hanger;

a sealing assembly above said holddown assembly for sealing said flow passages, said sealing assembly including a lower member, an intermediate member, an upper member, and first and second sealing means, said lower and upper members being reciprocably mounted on said intermediate member, said first sealing means being disposed between said lower and intermediate members and said second sealing means being disposed between said intermediate and upper members;

compression means for compressing said lower, intermediate and upper members together causing said first sealing means to seal with said hanger and intermediate member and said second sealing means to seal with said head and intermediate member, the compression load on said first sealing means being transmitted through said second sealing means.

* * * * *